US011951367B2

(12) United States Patent
Patterson et al.

(10) Patent No.: US 11,951,367 B2
(45) Date of Patent: Apr. 9, 2024

(54) GOLF BRUSH WITH RAMP HOUSING

(71) Applicants: Jerid Daron Patterson, Oklahoma City, OK (US); Landon David Highfill, Edmond, OK (US)

(72) Inventors: Jerid Daron Patterson, Oklahoma City, OK (US); Landon David Highfill, Edmond, OK (US)

( * ) Notice: Subject to any disclaimer, the term of this patent is extended or adjusted under 35 U.S.C. 154(b) by 328 days.

(21) Appl. No.: 17/219,560

(22) Filed: Mar. 31, 2021

(65) Prior Publication Data

US 2021/0307497 A1 Oct. 7, 2021

Related U.S. Application Data

(60) Provisional application No. 63/004,884, filed on Apr. 3, 2020.

(51) Int. Cl.

| | |
|---|---|
| ***A63B 57/60*** | (2015.01) |
| ***A46B 5/02*** | (2006.01) |
| ***A46B 5/04*** | (2006.01) |
| ***A46B 9/02*** | (2006.01) |
| ***A46B 9/06*** | (2006.01) |
| ***A46B 15/00*** | (2006.01) |
| ***A46D 1/00*** | (2006.01) |

(52) U.S. Cl.

CPC ..... *A63B 57/60* (2015.10); *A46B 5/02* (2013.01); *A46B 5/04* (2013.01); *A46B 9/026* (2013.01); *A46B 9/06* (2013.01); *A46B 15/0095* (2013.01); *A46B 15/0097* (2013.01); *A46D 1/0207* (2013.01); *A46B 2200/3073* (2013.01)

(58) Field of Classification Search

CPC .. A63B 57/60; A46B 5/02; A46B 9/02; A46B 9/026; A46B 9/06; A46B 2200/3073; A46B 9/00

USPC ..... 15/159.1, 160

See application file for complete search history.

(56) References Cited

U.S. PATENT DOCUMENTS

| | | | | |
|---|---|---|---|---|
| 2,210,365 | A * | 8/1940 | Gilpin | A47L 23/22 15/112 |
| 2,674,758 | A * | 4/1954 | Fay | A46B 15/00 15/160 |
| 4,464,072 | A * | 8/1984 | Norwell | A63B 57/60 15/21.2 |

(Continued)

OTHER PUBLICATIONS

Corner Scrub Brush, https://www.wasserstrom.com/restaurant-supplies-equipment/carlisle%C2%AE-36196614-blue-triangular-corner-scrub-brush-594971.

*Primary Examiner* — Laura C Guidotti
*Assistant Examiner* — Sharonda T Felton

(57) ABSTRACT

A golf brush with ramp housing is an apparatus intended to clean golf clubs in a user-friendly and versatile manner. To accomplish this, the apparatus includes a ramp shaped housing with a plurality of bristles. More specifically, the apparatus is a golf brush that may be fixed on the ground, hung up on a golf bag, or handheld, according to the user's preference. To that end, the golf brush includes a stepping platform with at least one gripping groove on which the user may step on while pulling a clubface upward across a plurality of bristles. Further, the golf brush includes a fastener port that provides versatility and ease of use and transportation. Furthermore, the ramp housing comprises a plurality of stabilizers, a wedge channel and a plurality of finger grooves for user-friendly and safe operation of the golf brush.

15 Claims, 5 Drawing Sheets

(56) References Cited

U.S. PATENT DOCUMENTS

| | | | | |
|---|---|---|---|---|
| 5,345,641 | A | 9/1994 | Webster | |
| 5,878,460 | A | 3/1999 | Bruce | |
| 6,393,648 | B1 * | 5/2002 | Reynolds | A46B 17/02 15/210.1 |
| 2011/0138557 | A1 * | 6/2011 | Herrmann | A46B 7/04 15/160 |
| 2014/0137440 | A1 | 5/2014 | Iceton | |

* cited by examiner

GOLF BRUSH WITH RAMP HOUSING

The current application claims a priority to the U.S. Provisional Patent application Ser. No. 63/004,884 filed on Apr. 3, 2020.

FIELD OF THE INVENTION

The present invention relates generally to a golf brush. More specifically the present invention is a user-friendly and versatile golf club cleaning brush with a ramp housing and a stepping platform with stabilizing features.

BACKGROUND OF THE INVENTION

While playing a game of golf, various terrain and natural features are encountered throughout the course. For example, it is not uncommon for grass, sand, water and other various debris to become attached to a clubface surface from a golf club, particularly irons and lofted irons. The proper maintenance and use of golf equipment can result in a noticeable difference in product life and performance. Taking proper care of golf clubs can be a simple task if the necessary tools are readily available. A common tool such as a golf brush is often used to clean the clubface surface of various golf clubs. Usually, golf brushes are designed to be handheld tools, but often fall short performance-wise. Further, use of personal launch monitors in golf is increasing rapidly and cleaning the clubface between each shot is necessary so that the clubface is consistently clean on each shot reducing variables in spin and flight a dirty club face and grooves could create. Launch monitors measure multiple metrics of golf ball flight like spin and launch angle, and a dirty iron clubface could affect the flight and spin of a golf ball. Thus, a golfer would want a consistently clean clubface on each shot while using a launch monitor to achieve consistent results and having an easily accessible cleaning brush fixed on the ground is a need of the field. Additionally, providing the user with a tool that is easily carried or transported allows the user to access the tool at any time and place. Thus, a golf club cleaning device that is both versatile, efficient, and user-friendly is a rare find in the current market.

It is an objective of the present invention to provide the user with a versatile and user-friendly golf brush. To accomplish this, the present invention comprises a ramp shaped housing with a plurality of bristles. More specifically, the present invention is a golf brush that may be fixed on the ground, hung up on a golf bag or handheld, according to the user's preference. To that end, the golf brush comprises a stepping platform with at least one groove on which the user may step on while pulling a clubface upward across a plurality of bristles. Further, the golf brush comprises a fastener port which provides versatility and ease of use and transportation. Furthermore, the ramp housing comprises a plurality of stabilizers, a wedge channel and a plurality of finger grooves for user-friendly and safe operation of the golf brush.

DETAIL DESCRIPTIONS OF THE INVENTION

Figure 1:
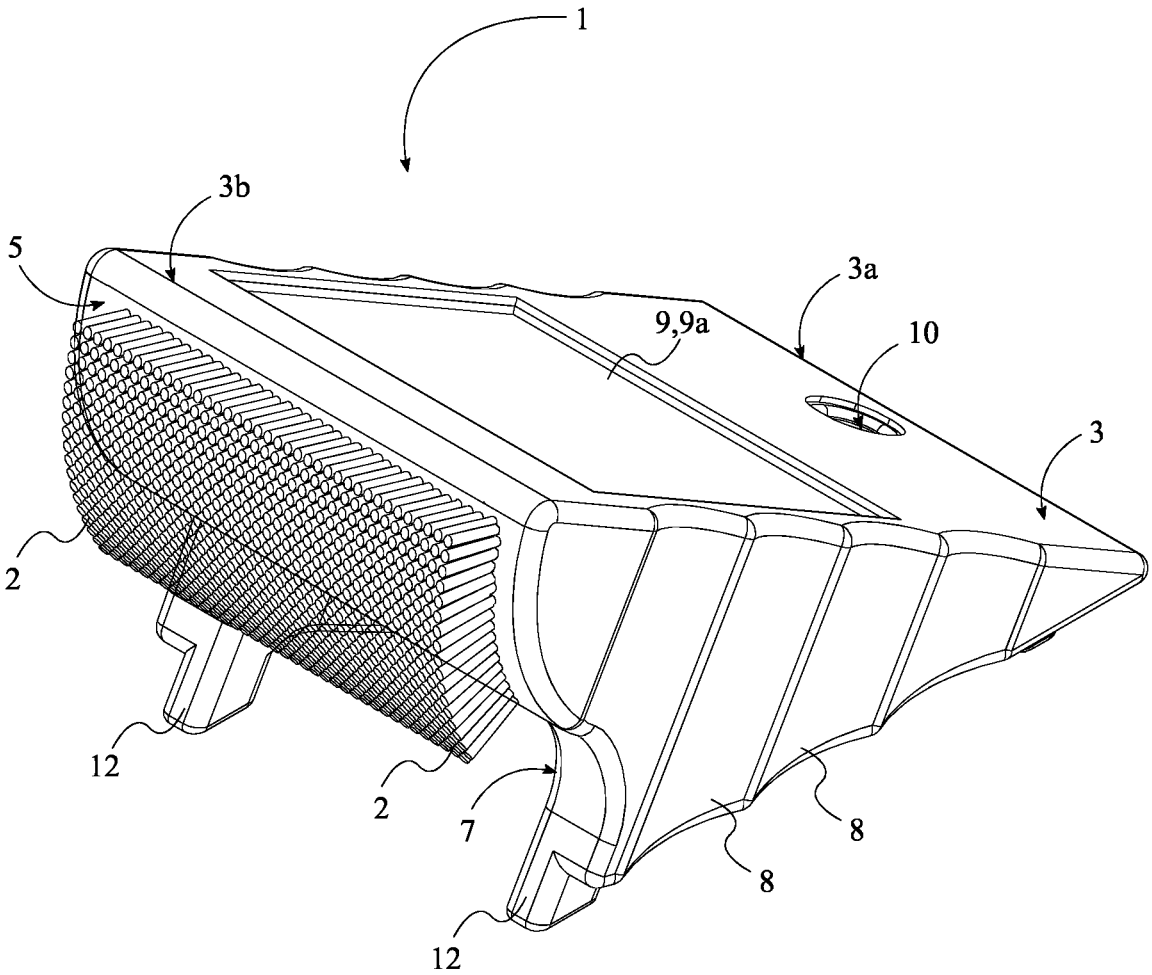
FIG. 1 is a top-front-left perspective view of the present invention.

All illustrations of the drawings are for the purpose of describing selected versions of the present invention and are not intended to limit the scope of the present invention.

In reference to FIG. 1 through FIG. 5, the present invention is a golf brush with a ramp housing. It is an objective of the present invention to provide the user with a versatile and user-friendly golf brush. To accomplish this, the present invention comprises a ramp shaped housing with a plurality of multi-textured bristles. More specifically, the present invention is a golf brush that may be fixed on the ground, hung up on a golf bag or handheld, according to the user's preference. To that end, the golf brush comprises a stepping platform with at least one groove on which the user may step on while pulling a clubface upward across a plurality of bristles. Further, the golf brush comprises a fastener port that provides versatility and ease of use and transportation. Furthermore, the ramp housing comprises a plurality of stabilizers, a wedge channel and a plurality of finger grooves for user-friendly and safe operation of the golf brush.

The following description is in reference to FIG. 1 through FIG. 5. According to a preferred embodiment of the present invention, the golf brush device comprises a brush-head body 1, and a plurality of bristles 2. Preferably, the brush head body 1 is a housing resembling a typical ramp, wherein the stepping platform is a slanted surface typically found on a ramp. To that end, the brush head body 1 comprises a first surface 3, a second surface 4, and a brush-head surface 5. As seen in FIG. 1, FIG. 2, FIG. 4 and FIG. 5, the first surface 3 and the second surface 4 are rectangular in shape. More specifically, the first surface 3 constitutes the slanted stepping platform, and the second surface 4 constitutes a ground-facing surface, wherein the first surface 3 and the second surface 4 come together at a connecting plane, creating an angle. Further, the first surface 3 is angularly offset from the second surface 4, and a first terminal edge 3*a* of the first surface 3 is connected to a second terminal edge 4*a* of the second surface 4, creating a vertex 6. In other words, opposite to the first surface 3 is the second surface 4, and second surface 4 is the face of the brush head body 1 that will be in contact with the ground.

Figure 3:
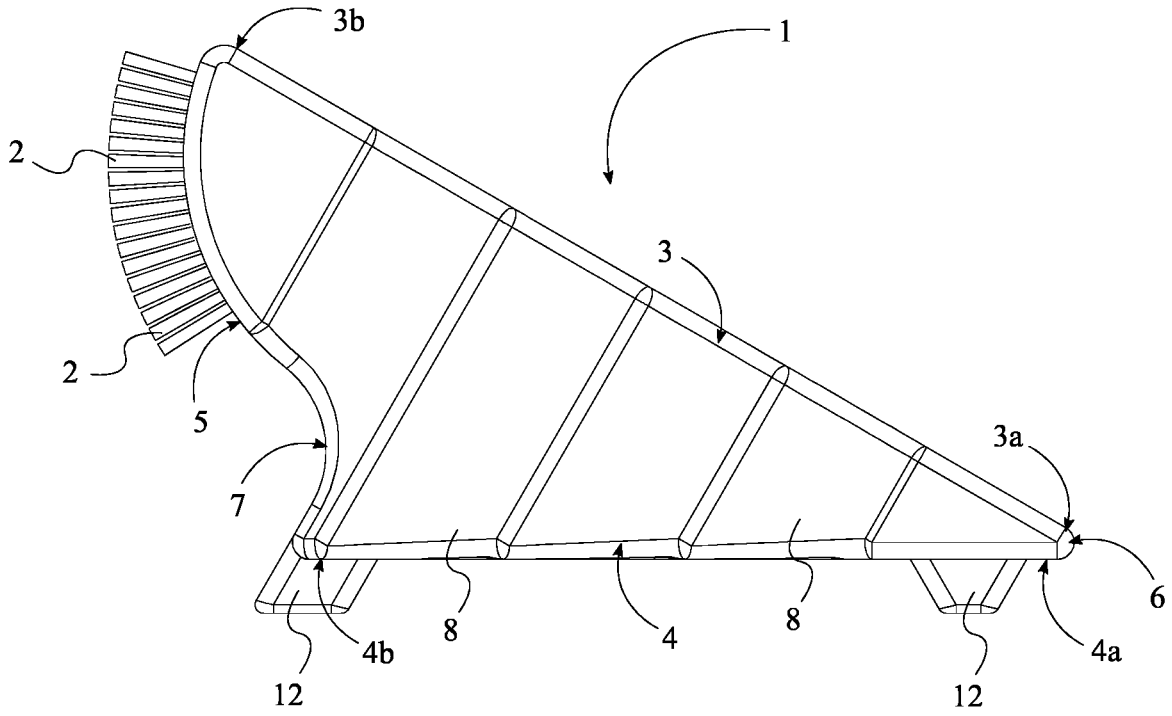
FIG. 3 is a left side elevational view of the present invention.

As seen in FIG. 1, and FIG. 3, the brush-head surface 5 is connected between a third terminal edge 3*b* of the first surface 3 and a fourth terminal edge 4*b* of the second surface 4, wherein the first terminal edge 3*a* is positioned opposite to the third terminal edge 3*b* across the first surface 3, and the second terminal edge 4*a* being positioned opposite to the fourth terminal edge 4*b* across the second surface 4. As seen in FIG. 3, the brush-head surface 5 is a bowed surface that is positioned normal to the first surface 3 and the plurality of bristles 2 is mounted onto the brush-head surface 5 opposite to the vertex 6. Further, as seen in FIG. 1, the plurality of bristles 2 is evenly distributed along the brush-head surface 5. More specifically, the plurality of bristles 2 located on the brush-head surface 5 protrude outward and contour to fit the brush-head surface 5 on its entirety. For the preferred embodiment, the material for the plurality of bristles 2 is nylon. In an alternate embodiment, the plurality of bristles 2 comprises a combination of both metallic and nylon bristles. However, the plurality of bristles 2 may comprise any other material, size, orientation, location, etc. that are known to one of ordinary skill in the art, as long as the intents of the present invention are not altered. Examples of such materials include, but are not limited to brass, plastic, hard silicone, fiber etc.

According to the preferred embodiment, the present invention comprises a channel 7. As seen in FIG. 3, the channel 7 laterally traverses through the brush-head body 1, and the channel 7 is positioned between the fourth terminal edge 4*b* of the second surface 4 and the brush-head surface 5. In other words, the channel 7 is located between the ground-side surface and the bowed surface of the ramp housing. Preferably, the channel 7 is a receding section whose profile shape is similar to a quarter circle. The quarter circle receding section acts as the wedge channel, that provides full access of the plurality of bristles 2 for any clubface, included lofted ones such as a wedge. To that end, the channel 7 is concave, and oriented opposite to the plurality of bristles 2. In the preferred embodiment, the concave quarter circle profile shape is chosen for the channel 7, but the profile shape for the channel 7 is not limited to such and can vary based on any design requirement and/or product development. Furthermore, as seen in FIG. 3, the brush-head surface 5 is convex, and oriented away from the channel 7. However, the channel 7 and the brush-head surface 5 may comprise any other shape and orientation, as long as the objectives of the present invention are fulfilled.

Figure 2:
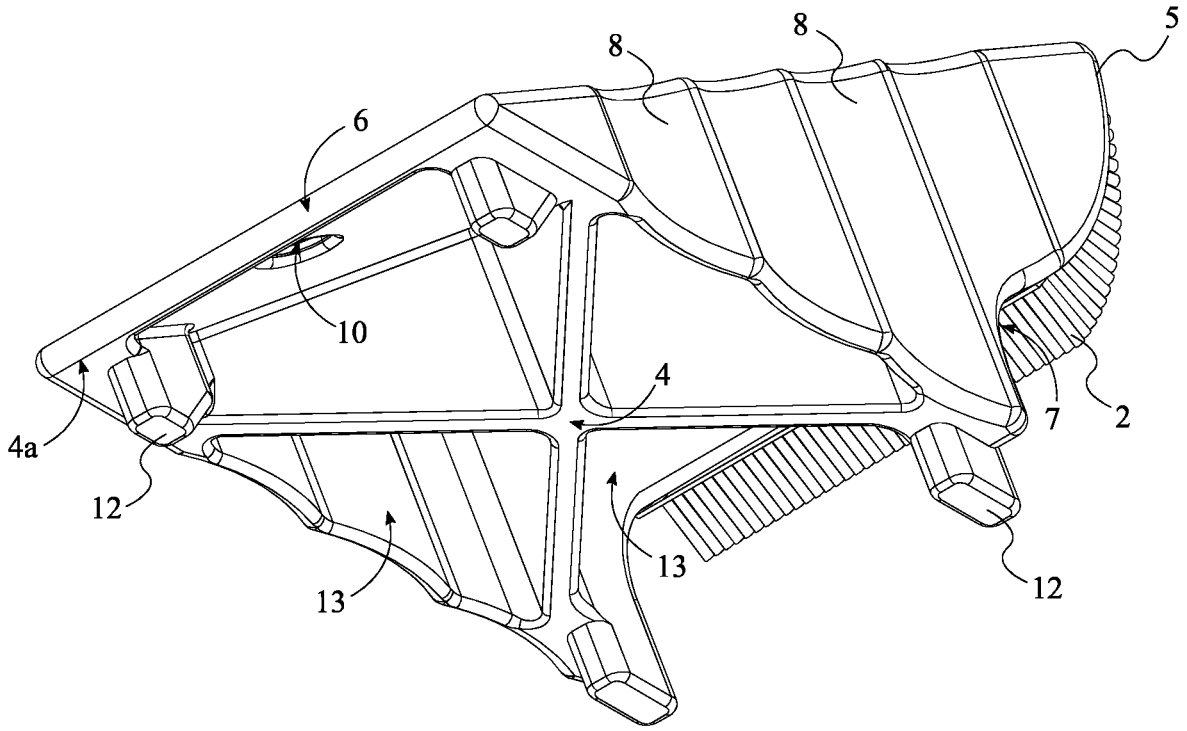
FIG. 2 is a bottom-rear-right perspective view of the present invention.
Figure 4:
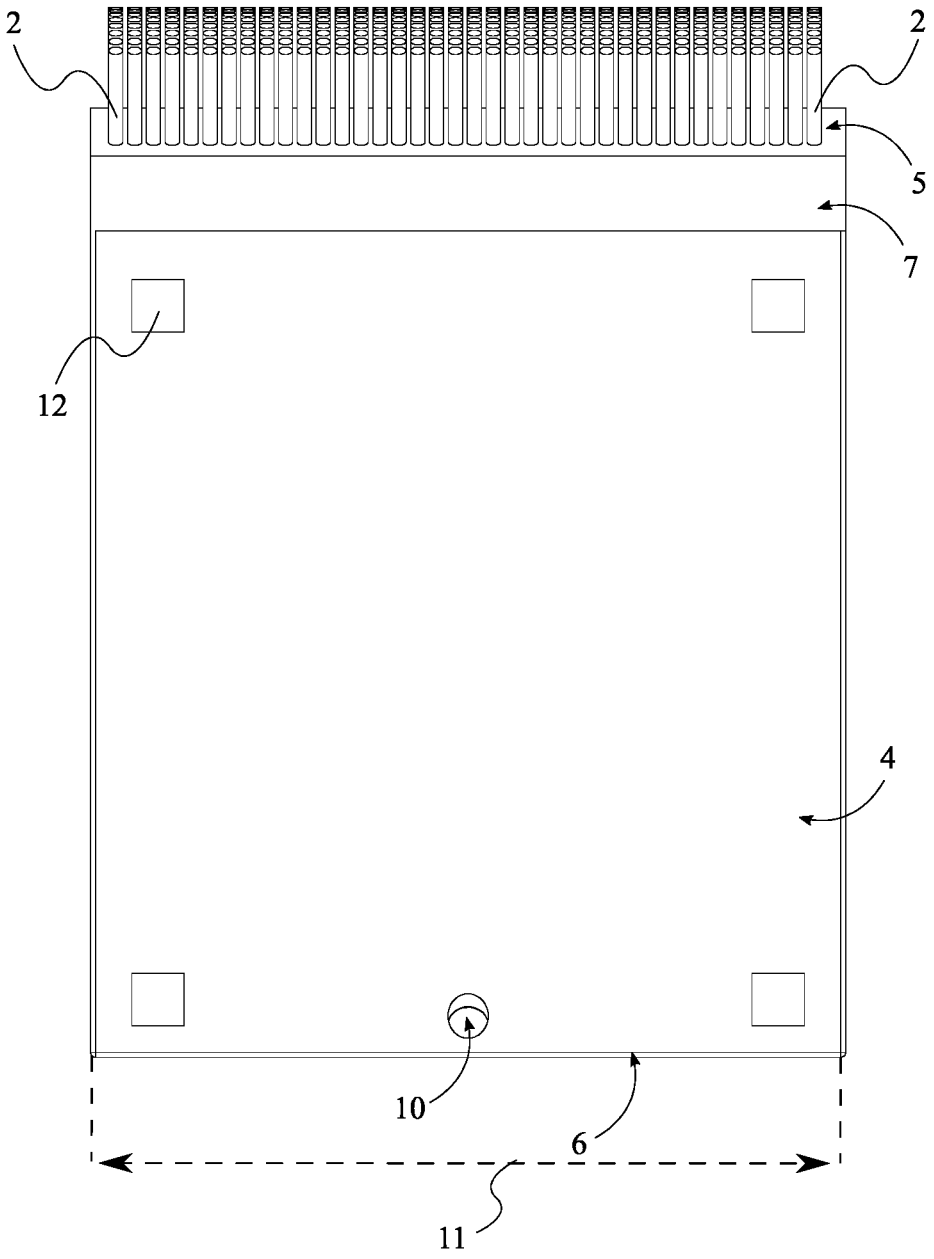
FIG. 4 is a bottom plan view of the present invention, wherein the bottom surface is solid.
Figure 5:
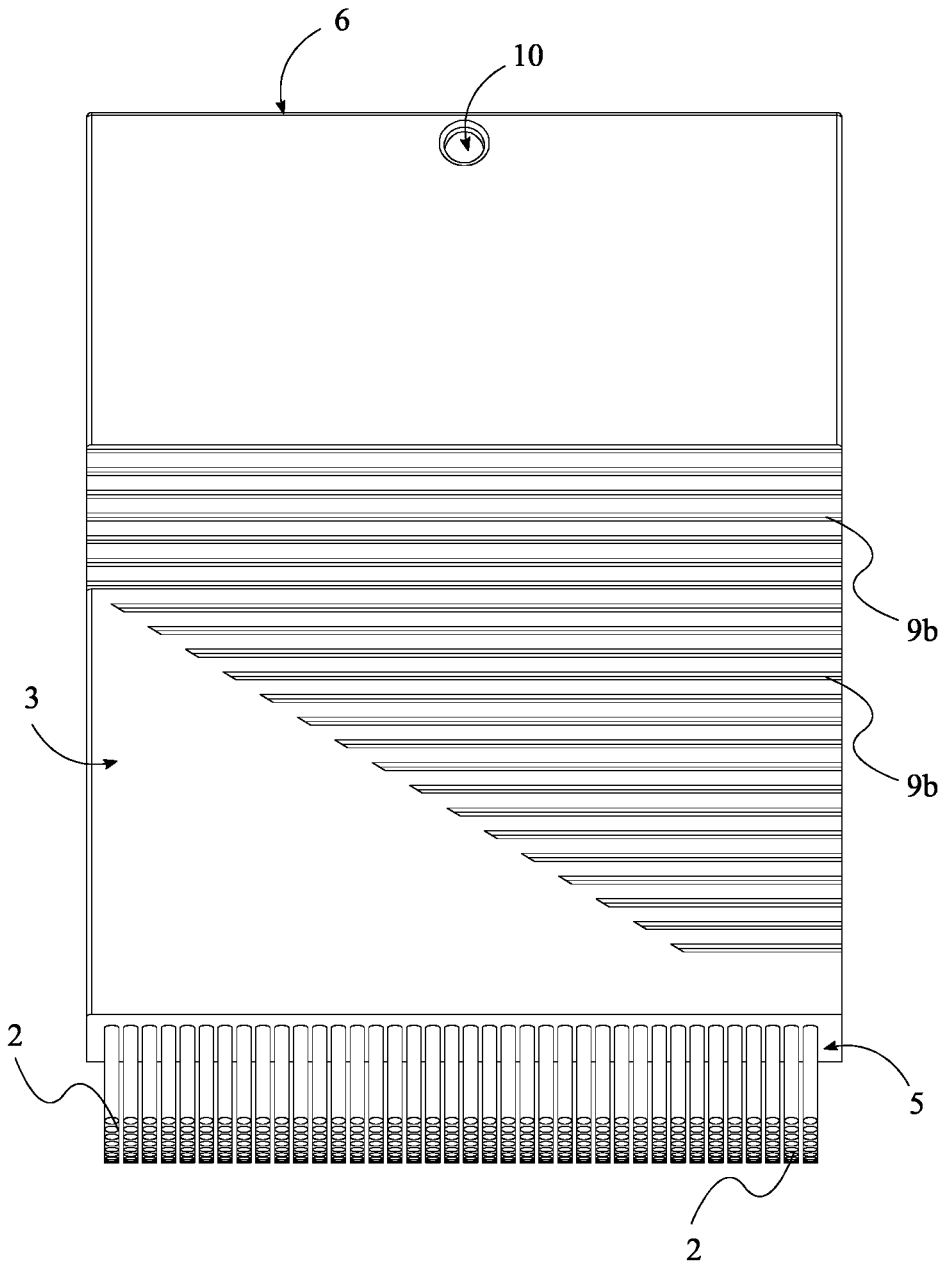
FIG. 5 is a top plan view of the present invention, wherein the ramp surface comprises a plurality of stability grooves.

Continuing with the preferred embodiment, the present invention comprises a plurality of gripping grooves 8, wherein the plurality of gripping grooves 8 is laterally mounted onto the brush body 1. The plurality of gripping grooves 8 comes in use when the present invention is used as a handheld device by the user to clean the clubface of a golf club. Preferably, the plurality of gripping grooves 8 is finger grips on each side of the brush body 1, intended to provide a stable hold in the golfer's hand to gently rub the plurality of bristles 2 on the iron or wedge clubface to clean the dirt from within the grooves and off the clubface between each shot. As seen in FIG. 1 through FIG. 3, the plurality of gripping grooves 8 comprises ridges and valleys so as to fit the fingers of a user in an ergonomic fashion. However, the plurality of gripping grooves 8 may comprise any other shape, size, orientation etc. that are known to one of ordinary skill in the art, as long as the intents of the present invention are not altered. Alternately, the lateral surfaces of the brush body 1 may by smooth, as seen in FIG. 4 and FIG. 5.

It is an aim of the present invention to provide users a stable stepping surface when the present invention is placed on the ground. In order to accomplish this, the present invention comprises at least one spike support 9, wherein the at least one spike support 9 is mounted onto the first surface 3. Preferably, the spike support 9 is intended to increase the friction between the stepping platform and the user's golf cleats. A preferred way of using the present invention while on the ground follows. The golfer may simply apply their foot on the first surface 3 with the toe of their shoe placed on the at least one spike support 9 and apply just enough pressure to stabilize the ramp while they use the club in their hand to gently brush the clubface on the plurality of bristles 2 to clean the iron or wedge grooves and clubface. A golfer would want a consistently clean clubface on each shot while using a launch monitor to achieve consistent results. Accordingly, while on a golf driving range, the present invention may be positioned on the ground near the golfers driving range balls and used to clean the clubface between each shot. Thus, the present invention provides the golfer a quick and easy way to clean their clubface efficiently between each shot while on the driving range or chipping area.

In reference to FIG. 1, the at least one spike support 9 may be a depression 9*a*. In other words, the depression 9*a* or a recessed square could provide a lip that golf spikes would catch on and improve traction. This arrangement enables the stepping platform to comprise a gripping support as well as a surface area large enough to include any form of logo, insignia or lettering. Alternately, as seen in FIG. 5, the at least one spike support 9 is a plurality of grooves 9*b*. Preferably, the plurality of grooves 9*b* is meant to aesthetically resemble the grooves typically found on the clubface surface of a golf iron, while providing functionality. However, the at least one spike support 9 may comprise any other size, shape, components, arrangement of components that are known to one of ordinary skill in the art, as long as the intents of the present invention are not altered.

It is an aim of the present invention to be used as a traditional golf brush while being attached to a golf bag. In order to accomplish this, and as seen in FIG. 1, FIG. 2, FIG. 4 and FIG. 5, the present invention comprises a fastener hole 10. Preferably, the fastener hole 10 normally traverses into the brush-head body 1 adjacent the vertex 6. In other words, the fastener hole 10 adjacent the end of the ramp provides a place to attach the present invention to a golf bag with a standard carabiner or other clip type device. Thus, while attached to a golf bag, the present invention may be used much like a traditional golf brush, that is to be used by hand to clean the dirt from iron grooves between each shot by brushing the face with the plurality of bristles 2. Further, as seen in FIG. 4, the fastener hole 10 is circular in shape and is positioned centrally along a width 11 of the first surface 3 adjacent the vertex 6. However, the fastener hole 10 may comprise any other size, dimension, orientation, position etc., as long as the objectives of the present invention are fulfilled.

It is the objective of the present invention to provide the user with a golf brush which comprises an arrangement of components such that the golf brush is hands-free. To that end, the present invention comprises a plurality of stabilizers 12. Preferably, the plurality of stabilizers 12 is mounted onto the second surface 4, opposite to the first surface 3. Further, the plurality of stabilizers 12 is perimetrically mounted onto the second surface 4 to achieve maximum stability. In other words, the plurality of stabilizers 12 is evenly distributed on the second surface 4, so as to touch the ground in a stable manner. The plurality of stabilizers 12 may comprise any size, shape, dimension etc. that are known to one of ordinary skill in the art, as long as the intends of the present invention are not altered.

In reference to FIG. 2, the present invention comprises at least one cavity 13, wherein the at least one cavity 13 normally traverses into the second surface 4. The at least one cavity 13 helps reduce the overall weight of the golf brush, helps with saving material, as well as provides aesthetic appeal. However, as seen in FIG. 4, the second surface 4 may be solid without any cavity. Thus, the present invention is a golf brush which comprises an arrangement of components that makes it versatile and user-friendly.

Although the invention has been explained in relation to its preferred embodiment, it is to be understood that many other possible modifications and variations can be made without departing from the spirit and scope of the invention as hereinafter claimed.

What is claimed is:

1. A golf brush device for cleaning clubface surface of golf clubs, comprising:

a brush-head body;

a plurality of bristles;

the brush-head body comprising a first surface, a second surface, and a brush-head surface;

the first surface being angularly offset from the second surface;

a first terminal edge of the first surface being connected to a second terminal edge of the second surface, creating a vertex;

the brush-head surface being connected between a third terminal edge of the first surface and a fourth terminal edge of the second surface;

the first terminal edge being positioned opposite to the third terminal edge across the first surface;

the second terminal edge being positioned opposite to the fourth terminal edge across the second surface;

the plurality of bristles being mounted onto the brush-head surface opposite to the vertex; and the plurality of bristles being evenly distributed along the brush-head surface;

a plurality of gripping grooves;

the plurality of gripping grooves being laterally mounted onto the brush body;

at least one spike support; and the at least one spike support being mounted onto the first surface; and wherein the at least one spike support being a plurality of grooves.

2. The golf brush device of claim 1, comprising:

a channel;

the channel laterally traversing through the brush-head body; and the channel being positioned between the fourth terminal edge of the second surface and the brush-head surface.

3. The golf brush device of claim 2, wherein the channel being concave, opposite to the plurality of bristles.

4. The golf brush device of claim 1, wherein the at least one spike support being a depression.

5. The golf brush device of claim 1, comprising:

a fastener hole;

the fastener hole normally traversing into the brush-head body adjacent the vertex.

6. The golf brush device of claim 5, wherein the fastener hole being positioned centrally along a width of the first surface adjacent the vertex.

7. The golf brush device of claim 1, comprising:

a plurality of stabilizers; and the plurality of stabilizers being mounted onto the second surface, opposite to the first surface.

8. The golf brush device of claim 7, wherein the plurality of stabilizers being perimetrically mounted onto the second surface.

9. The golf brush device of claim 1, comprising:

at least one cavity; and the at least one cavity normally traversing into the second surface.

10. The golf brush device of claim 1, wherein the plurality of bristles comprising a combination of both metallic and nylon bristles.

11. The golf brush device of claim 1, wherein the first surface and the second surface being rectangular.

12. The golf brush device of claim 1, wherein the brush-head surface being convex, and oriented away from the channel.

13. A golf brush device for cleaning clubface surface of golf clubs, comprising: a brush-head body; a plurality of bristles; a channel; the brush-head body comprising a first surface, a second surface, and a brush-head surface; the first surface being angularly offset from the second surface; a first terminal edge of the first surface being connected to a second terminal edge of the second surface, creating a vertex; the brush-head surface being connected between a third terminal edge of the first surface and a fourth terminal edge of the second surface; the first terminal edge being positioned opposite to the third terminal edge across the first surface; the second terminal edge being positioned opposite to the fourth terminal edge across the second surface; the plurality of bristles being mounted onto the brush-head surface opposite to the vertex; the plurality of bristles being evenly distributed along the brush-head surface; the channel laterally traversing through the brush-head body; and the channel being positioned between the fourth terminal edge of the second surface and the mounting brush-head surface; a plurality of gripping grooves; and the plurality of gripping grooves being laterally mounted onto the brush body; at least one spike support; and the at least one spike support being mounted onto the first surface; and wherein the at least one spike support being a plurality of grooves.

14. The golf brush device of claim 13, comprising:

a plurality of stabilizers; and the plurality of stabilizers being mounted onto the second surface, opposite to the first surface.

15. The golf brush device of claim 13, comprising:

a fastener hole; and the fastener hole normally traversing into the brush-head body adjacent the vertex.

* * * * *